United States Patent [19]

Pirk et al.

[11] Patent Number: 4,863,311

[45] Date of Patent: Sep. 5, 1989

[54] LINING FOR BORE HOLES IN SALT DOMES

[75] Inventors: Hans Pirk, Maintal; Paul Arntzen, Alzenau, both of Fed. Rep. of Germany

[73] Assignee: Nukem GmbH, Hanau, Fed. Rep. of Germany

[21] Appl. No.: 804,516

[22] Filed: Dec. 4, 1985

[30] Foreign Application Priority Data

Dec. 11, 1984 [DE] Fed. Rep. of Germany ..... 3445124

[51] Int. Cl.[4] ..... G21F 1/08; G21F 9/24

[52] U.S. Cl. ..... 405/128; 250/506.1; 252/633; 405/133; 405/153

[58] Field of Search ..... 405/54, 55, 128, 129, 405/150, 151, 146, 133, 153, 53; 250/506.1; 252/633; 52/125.1, 125.2, 125.3, 125.6

[56] References Cited

U.S. PATENT DOCUMENTS

| | | | |
|---|---|---|---|
| 1,378,158 | 5/1921 | West et al. | 405/151 |
| 1,854,324 | 5/1932 | Anderberg | 52/125.3 |
| 4,397,583 | 8/1983 | Horncy et al. | 405/150 |
| 4,453,081 | 6/1984 | Christ et al. | 250/506.1 |
| 4,456,827 | 6/1984 | Botzem et al. | 250/506.1 |
| 4,488,834 | 12/1984 | Hooper et al. | 405/55 |
| 4,545,701 | 10/1985 | Tsuzuki | 405/150 |
| 4,562,001 | 12/1985 | Vietzke et al. | 252/633 |
| 4,569,818 | 2/1986 | Popp et al. | 250/506.1 |

*Primary Examiner*—David H. Corbin

*Attorney, Agent, or Firm*—Cushmanm, Darby & Cushman

[57] ABSTRACT

To store radioactive materials in bore holes of salt domes these bore holes are lined with superimposed tubular sections made of metallic material including in each case of an outer ring and an inner ring which are securely joined together by an intermediate ring of an electrochemically nobler material; the joining of the tubular section with each other is carried out by welding the intermediate rings and by inserting support rings in corresponding recesses of the outer rings.

4 Claims, 1 Drawing Sheet

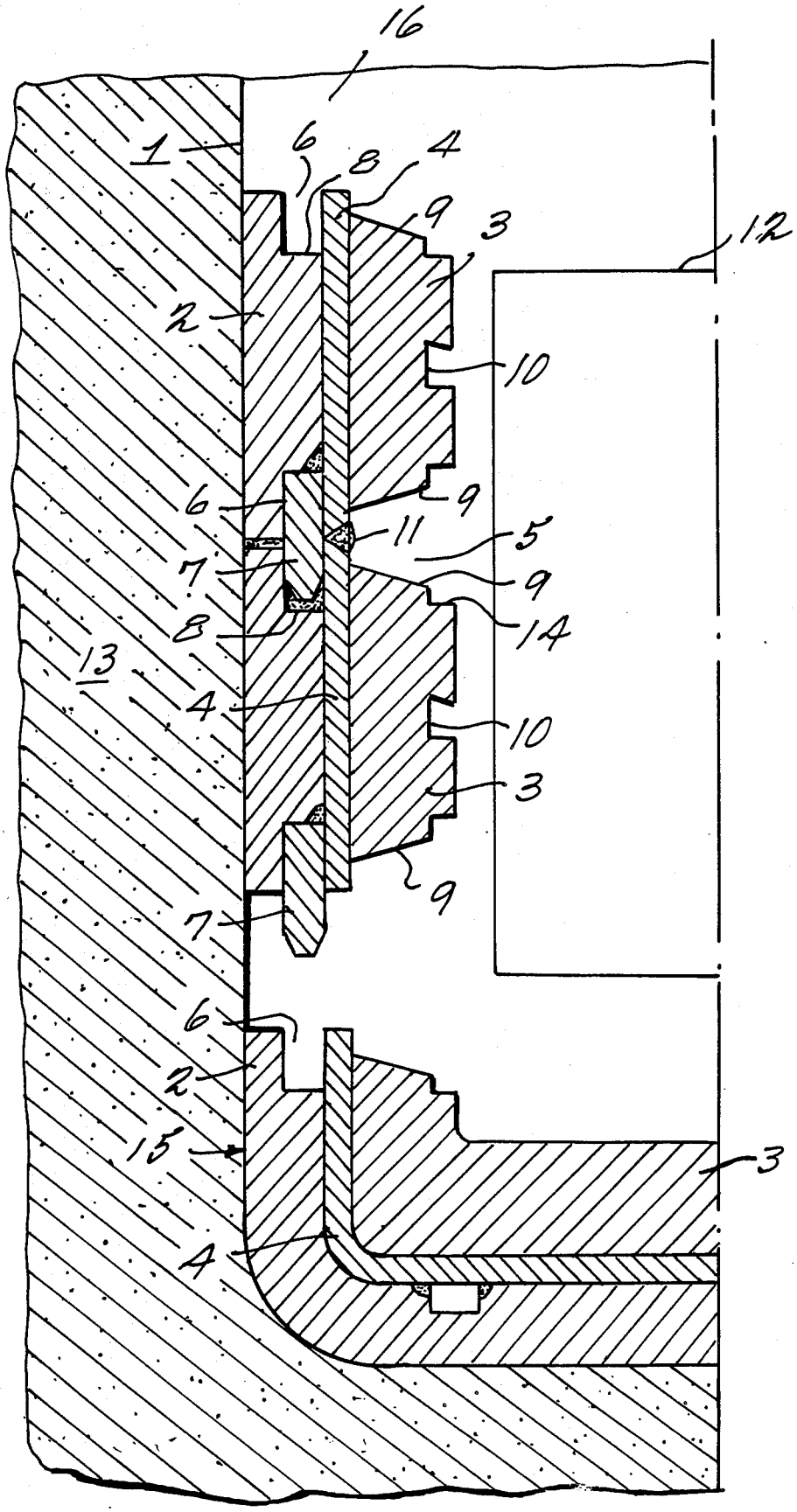
16
1
6
8
4
9
3
12
2
10
6
9
11
5
7
9
8
14
13
4
10
3
9
7
6
2
15
3
4

LINING FOR BORE HOLES IN SALT DOMES

BACKGROUND OF THE INVENTION

The present invention is directed to a lining or covering for bore holes in salt rocks used for storing radioactive materials, the bore holes consisting of superimposed tubular sections.

Radioactive waste after suitable conditioning are inserted into final storage containers and terminally stored in geological formations. The terminal storage containers are so designed that they safely surroud the radioactive inventory, block the radioactive rays, withstand the pressure of the rocks and also are effectively protected against corrosion during the longterm storage. Therefore, it has been the practice to make such terminal storage containers very expensively of steel, constructed partially in multiple layers, and provided with special corrosion protection devices. There are needed a large number of pieces of such expensive and relatively difficult to handle containers which are stored in caverns or bores without any possibility of recovery for reuse. This point is also true for containers and packages made of ceramic material which are besides, sensitive to the pressure of the rocks.

There are known from German No. OS 3034821 above ground intermediate storage members for radioactive materials in containers in which the shielding containers are located in superimposed tubular sections made of concrete. Likewise there are known storage tunnels lined or covered with concrete.

The present invention is based on the problem of providing a covering for bore holes in salt rocks for the storage of radioactive materials comprising superimposed tubular sections which make possible the receiving of the static shielding and corrosion protection members of terminal storage containers so that these can be laid out in their stored containers of lower weight but simply and at low cost in order to be easily and conveniently handled.

SUMMARY OF THE INVENTION

The objects were obtained according to the invention by making the tubular sections of a metallic material and having each of them composed of an outer ring and an inner ring which are securely joined together by an intermediate ring of a electrochemically nobler material, welding the intermediate rings of the individual tubular sections together, the inner rings being not as high as the outer and intermediate rings in order to form a recess in the interior of the covering.

The outer rings have upper and lower edges and directly engage an intermediate ring, whereby in each case there is applied in one of the recesses a support ring having twice the height of the depth of the recess and made of the same material as the intermediate ring and welded to the intermediate ring.

In assembly, one inserts each support ring in the free recess of each adjacent outer ring, whereby the bottom of the recess in the outer ring sets deeper than the bottom of the recess in the inner ring. It is advantageous if the inserted side of the support ring grasp the free recess of the adjacent outer ring and there are provided manipulated recesses in the inner ring.

Advantageously the inner rings and the outer rings comprise spherical case graphite.

BRIEF DESCRIPTION OF THE DRAWING

The single FIGURE of the drawing is a schematic, partially exploded view showing an illustrative form of the covering of the invention.

DETAILED DESCRIPTION

A borehole 16 is provided in a salt formation 13. The borehole 16 is tightly lined or covered by superimposed and welded together tubular sections 1 as well as with a correspondingly constructed bottom portion 15 on the bottom of the boreholes, which likewise is welded to the lowermost tubular section 1.

Each tubular section 1 consists of steel and is composed of three rings, an outer ring 2, an inner ring 3 and an intermediate ring 4. All three rings, 2, 3, and 4 are securely fixed to each other. The intermediate ring 4 consists of an electrochemically nobler material, than the material (e.g. spherical cast graphite) of the outer ring 2 and the inner ring 3. In the assembly of the total covering of the borehole 16 the tubular section 1 is joined by welding of the intermediate rings 4 with each other via the welding seam 11. In order that the welding can be carried out on the inside, the inner ring for forming a recess 5 has a lower height than the outer and intermediate rings 2 and 4. The recess 5 can have either a rectangular or trapezoidal cross-section. Optionally the recess 5 can contain a surface adapted to the welding apparatus and testing apparatus for guaranteeing the quality of the welding seam 11 respectively a correspondingly shaped recess 14.

The outer rings 2 have on the upper and lower edges directly on the intermediate ring 4 in each case a recess 6. In each of the recesses 6 there is applied a support ring 7 having double the height of the depth of the recess of the recess 6. The support ring 7 consists of the same material as the intermediate ring 4 and is welded to the intermediate ring 4. In the assembly of the total covering of the borehole 16 there is applied in each case a support ring 7 in the free recess of the adjacent outer ring. The bottom 8 of the recess 6 in the outer ring 2 thereby sits deeper in the inner ring 3 than the bottom 9 of the recess 5.

Altogether there are the following advantages:

In producing the welding seam 11 the weld melt is surrounded on all sides by the same material. As a result of this there is guaranteed a homogeneous structure in the welding seam and in the surrounding area and this guarantees a qualitatively trouble-free weld joint.

The support ring 7 takes on a static function in regard to the pressure of the rock against the recess 5 and at the same time relieves the welding seam 11.

During longterm storage or terminal storage of the terminal storage container or terminal storage package 12 the less noble outer ring 2 can be corroded or in the extreme case completely corroded away. The support ring 7 consisting of a nobler material in such a case supports the hold covered against the geological formation, in cooperation with the intermediate ring 4 protects before there is further corrosion and thus takes on a barrier function for the terminal storage container 12.

The total thickness of the tubular section 1 can be chosen so that additionally for the terminal storage container 12 also there can be assumed completely or to a high degree the shielding function against the radioactive rays of the radioactive container material.

The same is also true for the static function against the rock pressure so that the terminal storage container 12 can be reduced in size not only in regard to protection against rays but also in regard to stability.

The chief static function of the tubular section 1 thereby is assumed by the correspondingly laid out inner ring 3.

The covering of the invention thus is preeminently suited to take care of essential container functions so that the numerous terminal storage containers can be laid out tightly, but simply, at low-cost, easily and handled comfortably.

As an aid in the assembly of the tubular sections 1, as well as the bottom portion 15 in a bore hole, on one of the recesses 6 of each outer ring 2, there can be inserted a support ring 7 to facilitate interengagement between each layer of rings. In addition, the inner ring 3 may be provided with a recess 10 for cooperation with a manipulating device to facilitate movement of the rings.

The entire disclosure of German priority application No. P 3445124.2 is hereby incorporated by reference.

What is claimed is:

1. A lining for boreholes in salt domes for the storage of radioactive materials comprising superimposed tubular sections;

each tubular section being made of a metallic material and including an outer ring and an inner ring joined together by an intermediate ring, said intermediate ring being of an electrochemically nobler material than the inner and the outer ring, the said tubular sections being welded together by welds between adjacent intermediate rings, said inner rings having a smaller axial dimension than the outer and intermediate rings so as to define a set of axially spaced recesses along the inside of the lining, the outer rings having an inner surface engaging directly on the intermediate ring at a location spaced inwardly of the upper and lower edges of said intermediate ring so as to define upper and lower recesses, a support ring disposed in each said recess and being made of the same material as the intermediate ring and being welded to the intermediate ring.

2. A lining according to claim 1 wherein handling recesses are formed in the inner rings.

3. A lining according to claim 1 wherein the inner rings and outer rings are made of spherical cast graphite.

4. A lining according to claim 2 wherein the inner rings and outer rings are made of spherical cast graphite.

* * * * *